US011589720B2

(12) United States Patent
Davila et al.

(10) Patent No.: US 11,589,720 B2
(45) Date of Patent: Feb. 28, 2023

(54) FLOOR CLEANER

(71) Applicant: TECHTRONIC CORDLESS GP, Anderson, SC (US)

(72) Inventors: Rafael Davila, Kannapolis, NC (US); Michael Paul Dawson, Huntersville, NC (US); Robert McRorie, Huntersville, NC (US)

(73) Assignee: Techtronic Floor Care Technology Limited, Tortola (VG)

( * ) Notice: Subject to any disclaimer, the term of this patent is extended or adjusted under 35 U.S.C. 154(b) by 297 days.

(21) Appl. No.: 17/017,138

(22) Filed: Sep. 10, 2020

(65) Prior Publication Data

US 2021/0068599 A1 Mar. 11, 2021

Related U.S. Application Data

(60) Provisional application No. 62/898,822, filed on Sep. 11, 2019.

(51) Int. Cl.
*A47L 7/00* (2006.01)

(52) U.S. Cl.
CPC ..... *A47L 7/0028* (2013.01); *A47L 7/0042* (2013.01)

(58) Field of Classification Search
CPC ..... A47L 7/0028; A47L 7/0042
See application file for complete search history.

(56) References Cited

U.S. PATENT DOCUMENTS 6,687,952 B1 2/2004 Mohan, Jr.
7,159,271 B2 1/2007 Sepke et al.
7,293,324 B2 11/2007 Chui et al.
7,373,690 B2 5/2008 Sepke et al.
7,814,612 B2 10/2010 Sepke et al.
(Continued)

FOREIGN PATENT DOCUMENTS

CN 1611172 A 5/2005
CN 1666701 A 9/2005
(Continued)

OTHER PUBLICATIONS

International Search Report and Written Opinion for Application No. PCT/US2020/050161 dated Jan. 13, 2021 (14 pages).
(Continued)

*Primary Examiner* — Andrew A Horton
(74) *Attorney, Agent, or Firm* — Michael Best & Friedrich LLP

(57) ABSTRACT

A floor cleaner including a recovery. The recovery tank is configured to contain a fluid drawn through a suction inlet from a surface to be cleaned by a vacuum source. The recovery tank includes a shutoff float. The shutoff float is movable between a first position and a second position. The shutoff float includes a float body, a float closure, and a first interconnecting member. The first interconnecting member engages a second interconnecting member to retain the float in the first position. In the first position, the shutoff float is spaced a distance from the suction air outlet, allowing air flow through the suction air outlet. The first interconnecting member engages the second interconnecting member to retain the shutoff float in the first position. In the second position, the shutoff float is adjacent the suction air outlet, inhibiting air flow through the suction air outlet.

20 Claims, 11 Drawing Sheets

(56) References Cited

U.S. PATENT DOCUMENTS

| | | | | |
|---|---|---|---|---|
| 7,945,989 | B2 | 5/2011 | Sepke et al. | |
| 8,448,293 | B2 | 5/2013 | Sepke | |
| 8,516,650 | B2 | 8/2013 | Beers | |
| 9,591,954 | B1 | 3/2017 | Seasholtz et al. | |
| 10,292,551 | B2 | 5/2019 | Seasholtz et al. | |
| 2004/0006843 | A1 | 1/2004 | Cankurtaran | |
| 2005/0060832 | A1 | 3/2005 | Chui et al. | |
| 2005/0091783 | A1 | 5/2005 | Sepke et al. | |
| 2006/0090288 | A1 | 5/2006 | Lee et al. | |
| 2007/0107158 | A1 | 5/2007 | Fan | |
| 2008/0189901 | A1 | 8/2008 | Jansen | |
| 2009/0094778 | A1 | 4/2009 | Beers | |
| 2009/0123293 | A1 | 5/2009 | Gierer et al. | |
| 2015/0223658 | A1* | 8/2015 | Holsten | A47L 9/2821 200/61.2 |
| 2017/0049282 | A1 | 2/2017 | Seasholtz et al. | |

FOREIGN PATENT DOCUMENTS

| | | | |
|---|---|---|---|
| CN | 1838907 | A | 9/2006 |
| CN | 203138358 | U | 8/2013 |
| CN | 204033266 | U | 12/2014 |
| CN | 105534423 | A | 5/2016 |
| CN | 205458469 | U | 8/2016 |
| CN | 208905598 | U | 5/2019 |
| EP | 2108732 | A1 | 10/2009 |
| JP | 2002102124 | A | 4/2002 |
| KR | 101065676 | B1 | 9/2011 |
| WO | 2008003332 | A1 | 1/2008 |
| WO | 2010047026 | A1 | 4/2010 |

OTHER PUBLICATIONS

Chinese Patent Office Action for Application No. 202080071498.4 dated Dec. 6, 2022 (7 pages including statement of relevance).

* cited by examiner

FLOOR CLEANER

CROSS-REFERENCE TO RELATED APPLICATIONS

This application claims priority to U.S. Provisional Patent Application No. 62/898,822, filed Sep. 11, 2019, the entire contents of which are hereby incorporated by reference herein.

BACKGROUND

The present invention relates to floor cleaners.

SUMMARY

In one embodiment a floor cleaner is disclosed, the floor cleaner including a vacuum source, a suction inlet in fluid communication with the vacuum source, and a recovery tank in fluid communication with the vacuum source and the suction inlet. The recovery tank is configured to contain a fluid drawn by the vacuum source through the suction inlet from a surface to be cleaned. The recovery tank includes a tank body, a tank inlet, a suction air outlet, a shutoff float, and a float cage. The shutoff float includes a float body, a closure, and a first interconnecting member. The float cage has a first end and a second end, the second end surrounding the suction air outlet. The recovery tank further includes a second interconnecting member configured to engage the first interconnecting member. The shutoff float is positionable between a first position and a second position. In the first position the first interconnecting member engages the second interconnecting member to retain the closure a predetermined distance from the suction air outlet inhibiting movement of the shutoff float toward the suction air outlet. In the second position the closure is adjacent the second end of the float cage and is in communication with the suction air outlet. The shutoff float is movable between the first position and second position when the first interconnecting member disengages the second interconnecting member.

In another embodiment a floor cleaner is disclosed including a vacuum source, a suction inlet in fluid communication with the vacuum source, and a recovery tank in fluid communication with the vacuum source and the suction inlet. The recovery tank is configured to contain a fluid drawn by the vacuum source through the suction inlet from a surface to be cleaned. The recovery tank includes a tank body, a tank inlet, a suction air outlet, a float, and a float guide. The float includes a float body, a float closure, and a first interconnecting member. The float guide includes a second interconnecting member configured to engage the first interconnecting member. The float guide is configured to direct the float from a first position in which the first interconnecting member engages the second interconnecting member retaining the closure a predetermined distance from the suction air outlet inhibiting movement of the float toward the suction air outlet and enabling air flow through the outlet toward a second position in which the closure is in communication with the outlet inhibiting air flow through the outlet. The float is movable between the first position and the second position when the first interconnecting member disengages the second interconnecting member.

Other aspects of the invention will become apparent by consideration of the detailed description and accompanying drawings.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

DETAILED DESCRIPTION

Figure 1:
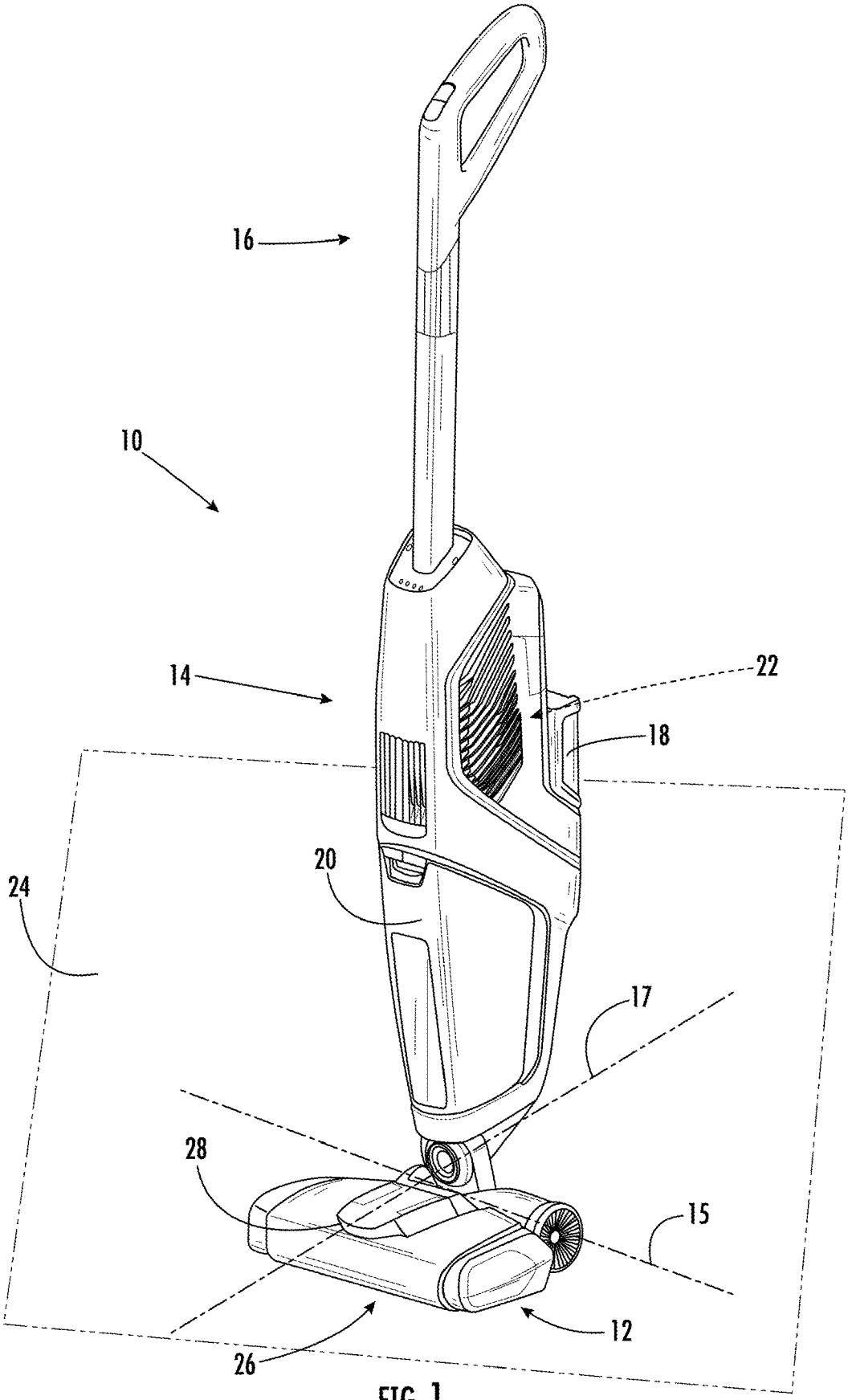
FIG. 1 is a perspective view of a floor cleaner according to one embodiment.
Figure 2:
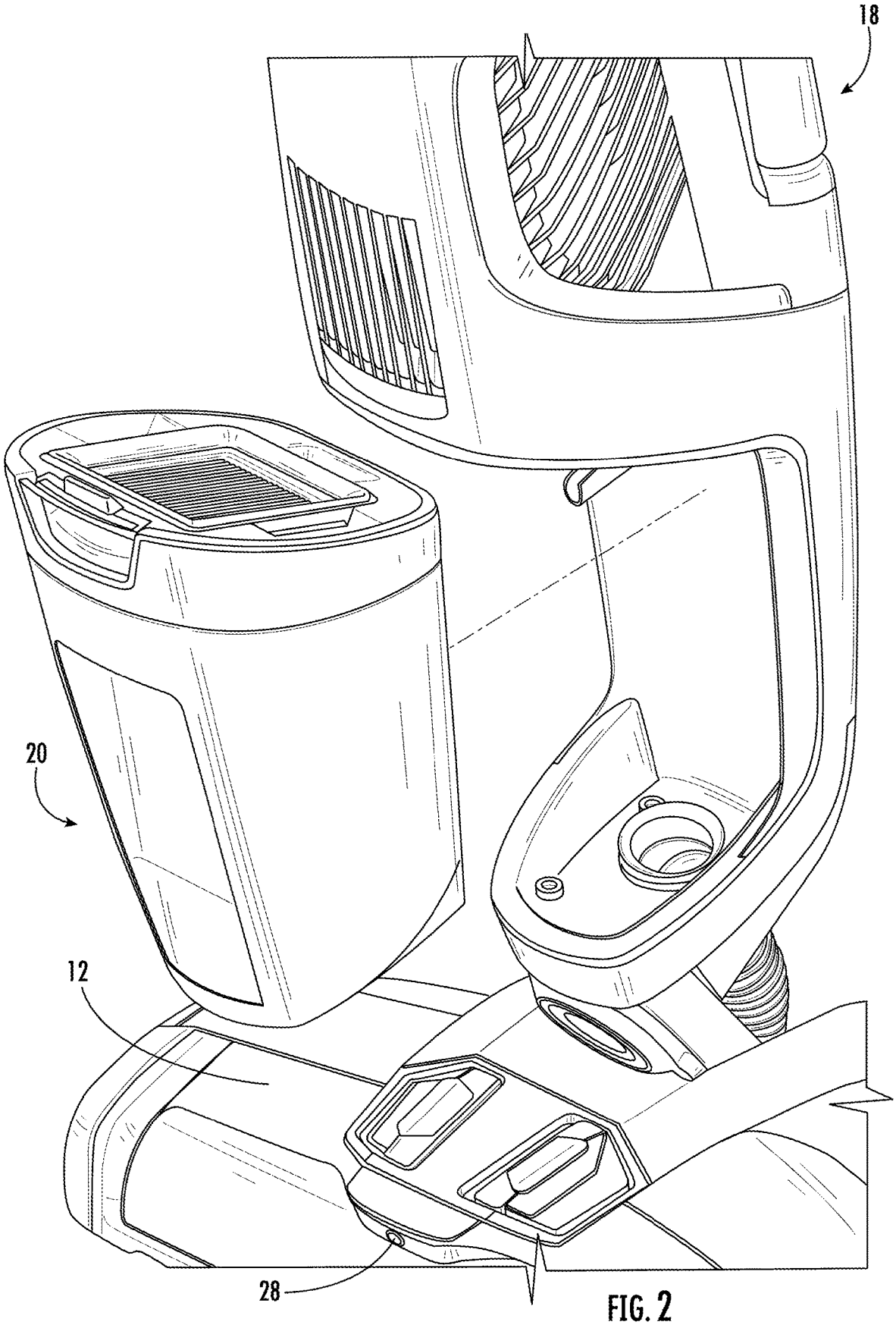
FIG. 2 is a partial view of the floor cleaner of FIG. 1 illustrating a recovery tank removed from the floor cleaner.

FIG. 1 illustrates a floor cleaner 10. The floor cleaner 10 includes a supply tank 18, a recovery tank 20, a distribution nozzle 28, a suction inlet 26, and a vacuum source 22. The distribution nozzle 28 is operable to dispense a fluid from the supply tank 18 onto a surface to be cleaned 24. The vacuum source 22 generates a suction airflow to draw fluid from the surface to be cleaned 24, through the suction inlet 26 and into the recovery tank 20. The recovery tank 20 is configured to contain the fluid and includes an inlet 52, a suction air outlet 50, and a shutoff float 32. The shutoff float 32 is positionable in a first position that allows air flow through the suction air outlet 50 when the fluid in the recovery tank 20 is below a predetermined level, and a second position that inhibits suction air flow through the suction air outlet 50 when the fluid in the recovery tank 20 is above a predetermined level.

Figure 4:
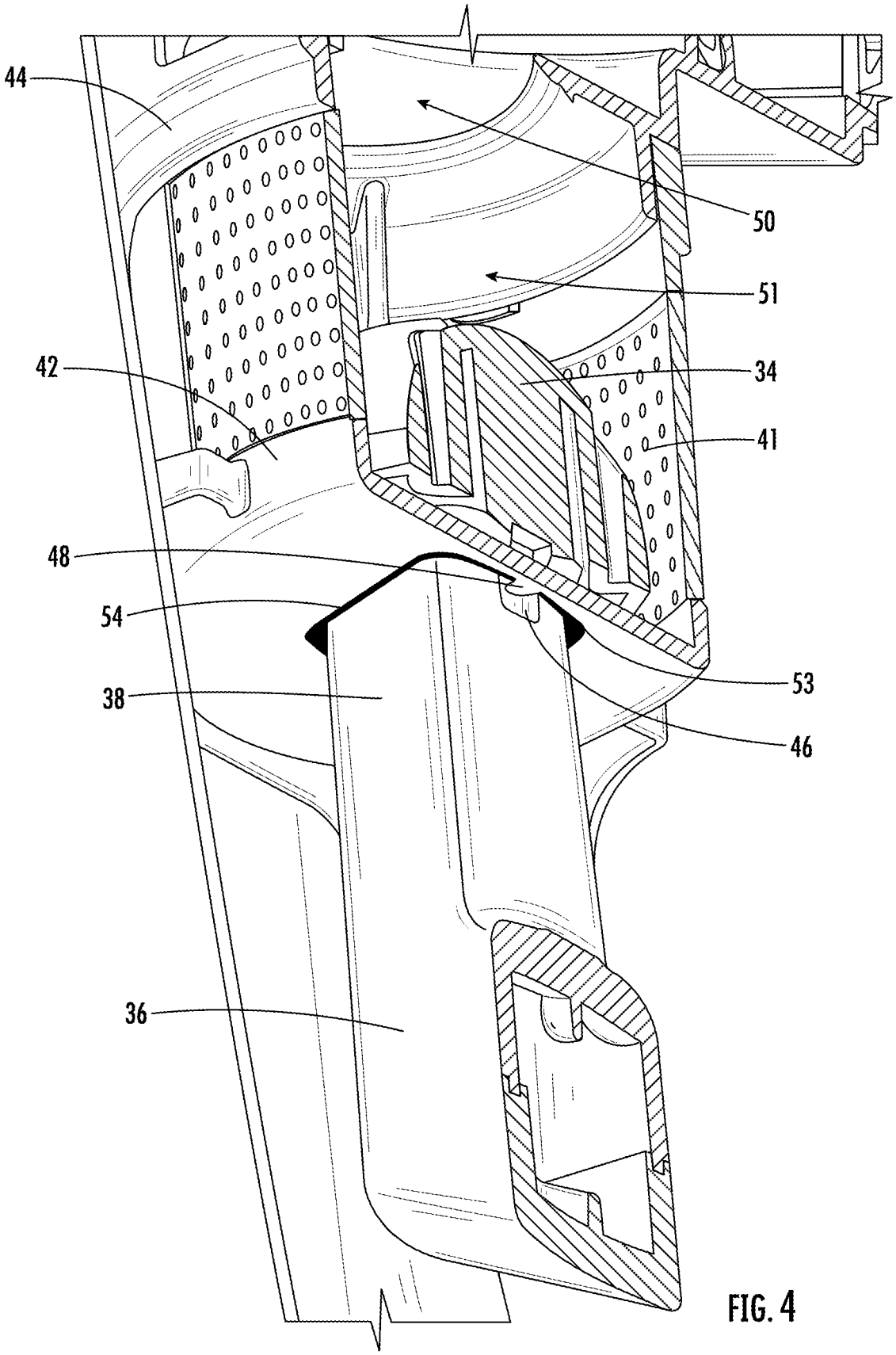
FIG. 4 is a partial cross-sectional view of the shutoff float and float cage of FIG. 3 with the shut off float in a first position.

Referring to FIG. 4, the shutoff float 32 includes a first interconnecting member 46 that cooperates with a second interconnecting member 48 in the recovery tank 20 to retain the shutoff float 32 in the first position when the fluid in the recovery tank 20 is below the predetermined level. The float 32 is retained inhibiting movement of the shutoff float toward the suction air outlet 50 such that the float 32 stays in place during movement of the floor cleaner 10. For example, the movement of the floor cleaner 10 may include pushing and pulling the floor cleaner 10 across the surface 24 (FIG. 1), steering the floor cleaner (e.g., pivotal movement of the handle portion 16 about axis 17), and pivoting the handle portion 16 about axis 15. The float 32 is retained in position until the fluid level rises in the recovery tank 20 to the predetermined level releasing the float 32 from its retained position to float on the fluid.

In the embodiment of FIG. 1, the floor cleaner 10 includes a user manipulatable handle portion 16 pivotally connected to a base 12 about a first axis 15 parallel to the surface to be cleaned 24 to allow the handle portion 16 to pivot between an upright position and an inclined use position. The recovery tank 20 is connected to the handle portion 16.

Figure 5:
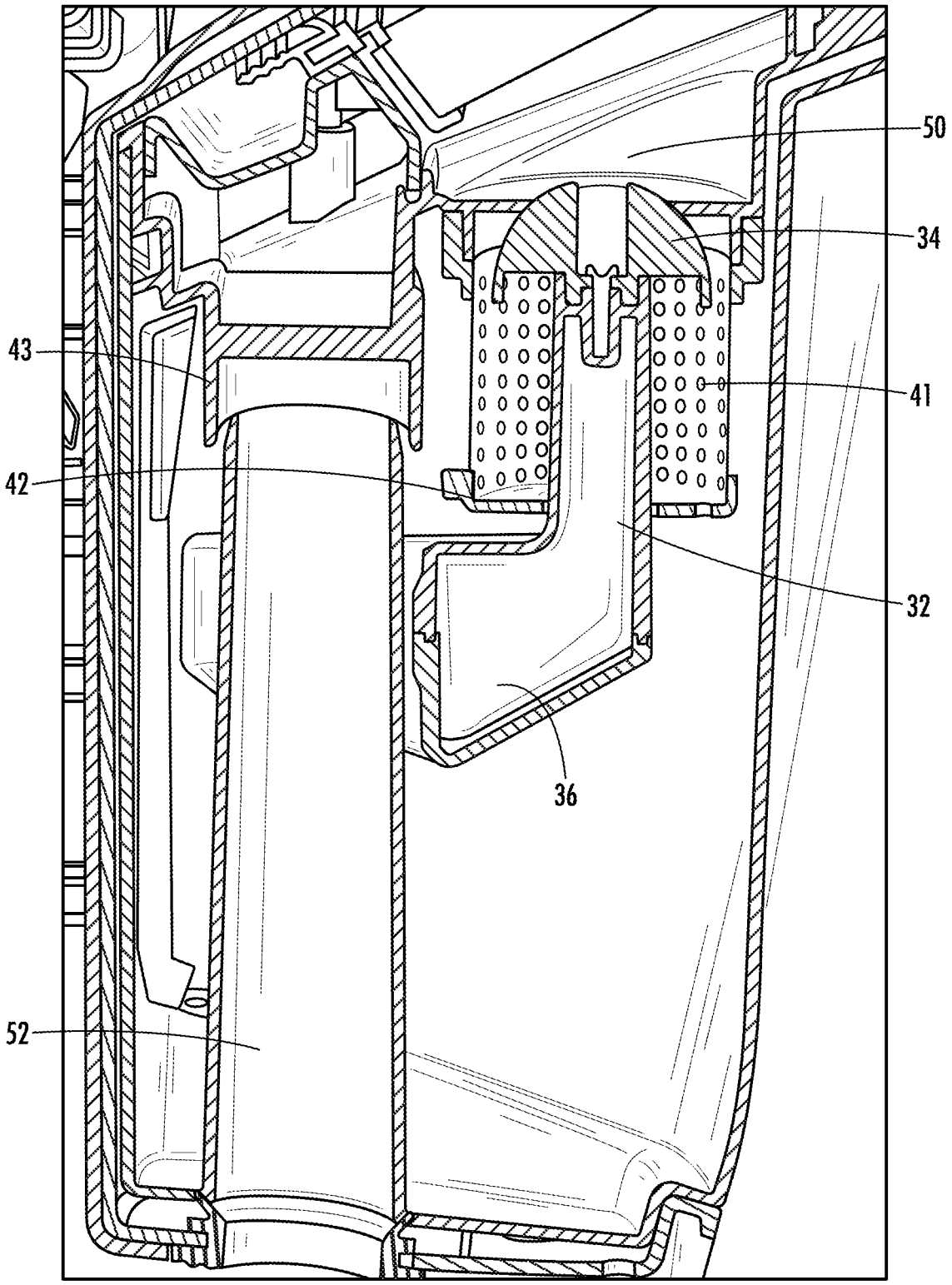
FIG. 5 is a partial cross-sectional view of the recovery tank of FIG. 3 with the shutoff float in a second position.

Referring to FIGS. 4 and 5, the shutoff float 32 comprises a float body 36, a closure 34, and a neck 38 that extends from the float body 36. As air and fluid enter the recovery tank 20 through the tank inlet 52, fluid is separated from the air by baffles forming an air/water separator 43 and collected in the recovery tank 20 such that the float body 36 floats on the fluid in the recovery tank 20. As the fluid level in the recovery tank 20 rises, the shutoff float 32 is directed toward the suction air outlet 50, and with continued fluid ingress the closure 34 is raised until the closure 34 is received in the suction air outlet 50 to close the suction air outlet 50 when the fluid reaches or exceeds a desired level. The float 32 can be directed toward the suction air outlet 50 by a float guide 40 such as one or more guiding ribs, a rod, a shaft, a sleeve, a bushing, a tube, a float cage, or other components or techniques that guide the float toward the suction air outlet as fluid rises in the tank.

Figure 3:
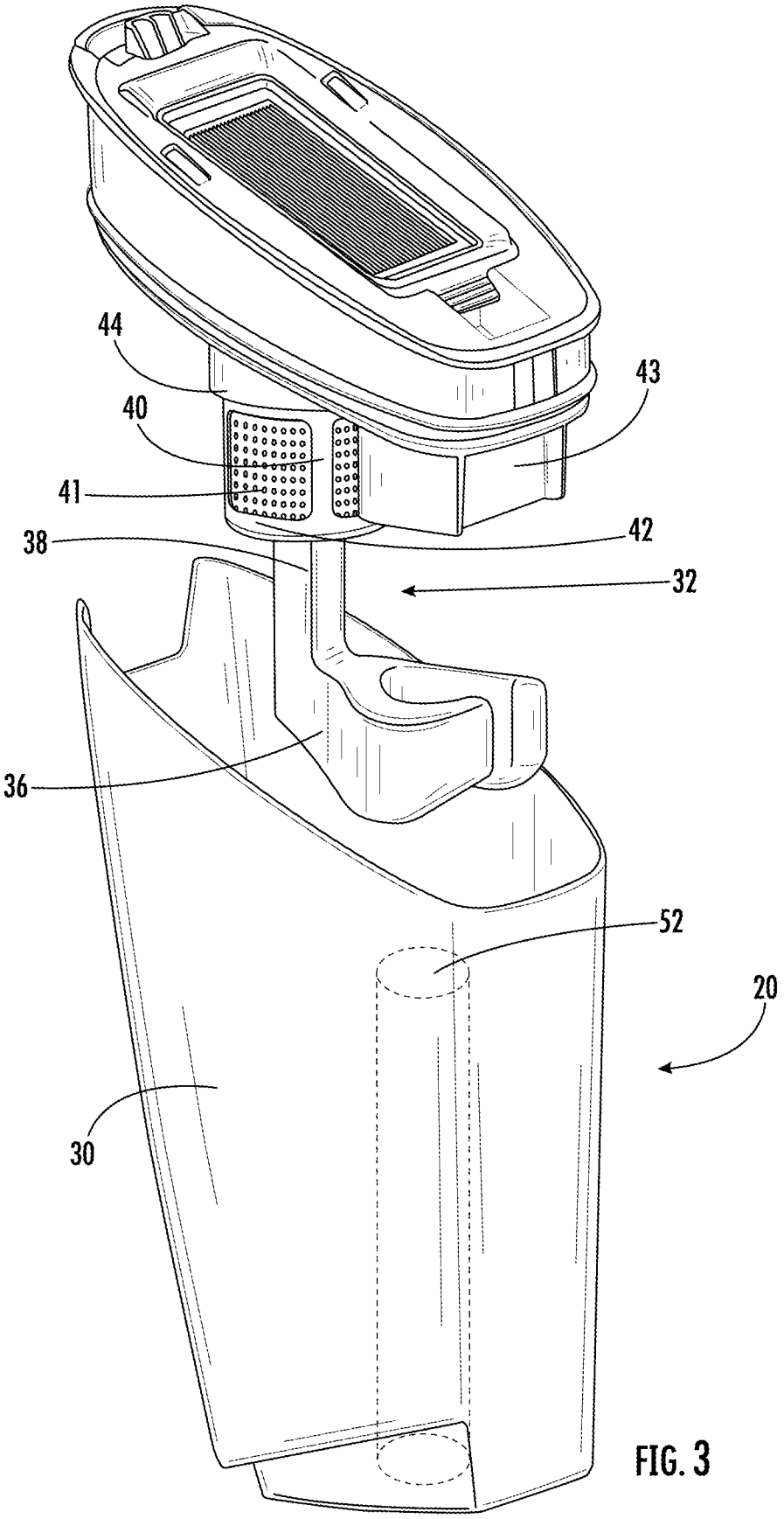
FIG. 3 is a partially exploded view of the recovery tank of the floor cleaner of FIG. 1 illustrating a shutoff float and float cage.

In the embodiment illustrated in FIGS. 3-5, the float guide 40 directs the float 32 toward the suction air outlet 50 by a float cage 40. The float cage 40 has a first end 42 and a second end 44 opposite the first end 42. The second end 44 surrounds the suction air outlet 50. In one embodiment, the float cage 40 includes a screen 41 that filters suction air flow before the suction air outlet 50. The screen 41 forms a peripheral surface of the float cage 40 between the first end 42 and the second end 44.

The shutoff float 32 is retained in the first position when the fluid in the recovery tank 20 is below the predetermined level by engagement of a first interconnecting member 46 and a second interconnecting member 48. Stated another way, the first interconnecting member 46 engages the second interconnecting member 48 in the first position retaining the closure 34 a predetermined distance from the suction air outlet, inhibiting movement of the shutoff float 32 toward the suction air outlet 50. In this embodiment, the neck 38 of the float 32 includes the first interconnecting member 46. The first end 42 of the float cage 40 includes the second interconnecting member 48 configured to engage the first interconnecting member 46. In the illustrated embodiment, the first interconnecting member 46 is a recess and the second interconnecting member 48 is a tab that engages the recess when the float 32 is in the first position. In one embodiment, the first interconnecting member 46 is a tab and the second interconnecting member 48 is a recess. In other embodiments, the interconnecting members may be other features or shapes configured to engage one interconnecting member with another interconnecting member in the first position, such as an abutment engaging a mating surface, a first protrusion engaging a second protrusion, a first contact surface engaging a second contact surface, or other interconnecting members. Engagement between the first and second interconnecting members may be by any connection or locking engagement, including by a surface on one member being in contact with a surface on the other member retained by sliding friction.

The shutoff float 32 is movable between the first position where the closure 34 is adjacent the first end 42 (FIG. 4) and the second position where the closure 34 is adjacent the second end 44 (FIG. 5). In one embodiment, the neck 38 extends through an aperture 53 in the first end 42 (FIGS. 4 and 5) of the float cage 40 and the float body 36 is positioned external the float cage 40. When fluid enters the recovery tank 20 and lifts the float body 36, the shutoff float 32 moves from the first position to the second position, and the closure 34 moves within the float cage 40. In the first position the shutoff float 32 is a predetermined distance away from the suction air outlet 50, allowing air flow through the suction air outlet 50. In the second position the closure 34 is adjacent to, and in communication with, the suction air outlet 50 (FIG. 5) inhibiting air flow through the suction air outlet 50.

Gravity causes the shutoff float 32 to move downwardly in the absence of fluid in the recovery tank 20. When the shutoff float 32 moves to the first position by gravity, the position and weight of the float 32 cause the first and second interconnecting members 46 and 48 to engage and retain the float 32 in the first position. Once the fluid in the recovery tank 20 reaches or exceeds a predetermined level, buoyancy exerted by the fluid on the float body 36 causes the first interconnecting member 46 to disengage the second interconnecting member 48, enabling the float body 36 to float on the fluid. As the fluid level rises in the recovery tank 20, the shutoff float 32 is guided into the second position in which the closure 34 of the shutoff float 32 is in communication with the suction air outlet 50 when the fluid reaches the predetermined level. When the shutoff float 32 is in the second position, the closure 34 reduces or inhibits airflow through the suction air outlet 50 when the fluid reaches the predetermined level, thereby reducing or inhibiting the suction airflow through the floor cleaner 10 to reduce additional fluid from entering the recovery tank 20 and to inhibit fluid from passing through the suction air outlet 50.

With reference to FIG. 4, in one embodiment, a gasket 54 at least partially closes a gap between the shutoff float 32 and an edge of the aperture 53 in the first end 42 of the float cage 40 to inhibit debris entering the float cage 40 through the aperture 53. The gasket 54 may be provided around the neck 38, closure 34, or other portion of the float 32 to at least partially close the aperture 53 when the shutoff float 32 is in the first position. In one embodiment, the first end 42 of the float cage 40 includes the gasket 54 at least partially closing the aperture 53 configured to engage the shutoff float 32 to inhibit debris entering the float cage 40 when the shutoff float 32 is in the first position. In one embodiment, the gasket 54 at least partially closes the aperture 53 to inhibit debris entering the float cage 40 when the shutoff float 32 moves from the first position to the second position.

In the embodiment shown in FIGS. 6-11, the floor cleaner 10 includes a recovery tank 20 having an alternative arrangement in fluid communication with the vacuum source 22 and the suction inlet 26. The recovery tank 20 includes an inlet 52, an air outlet 50 with an outlet passageway 51, and a shutoff float 132. The float 132 includes a float body 136, a closure 134, and a neck 138.

Figure 7:
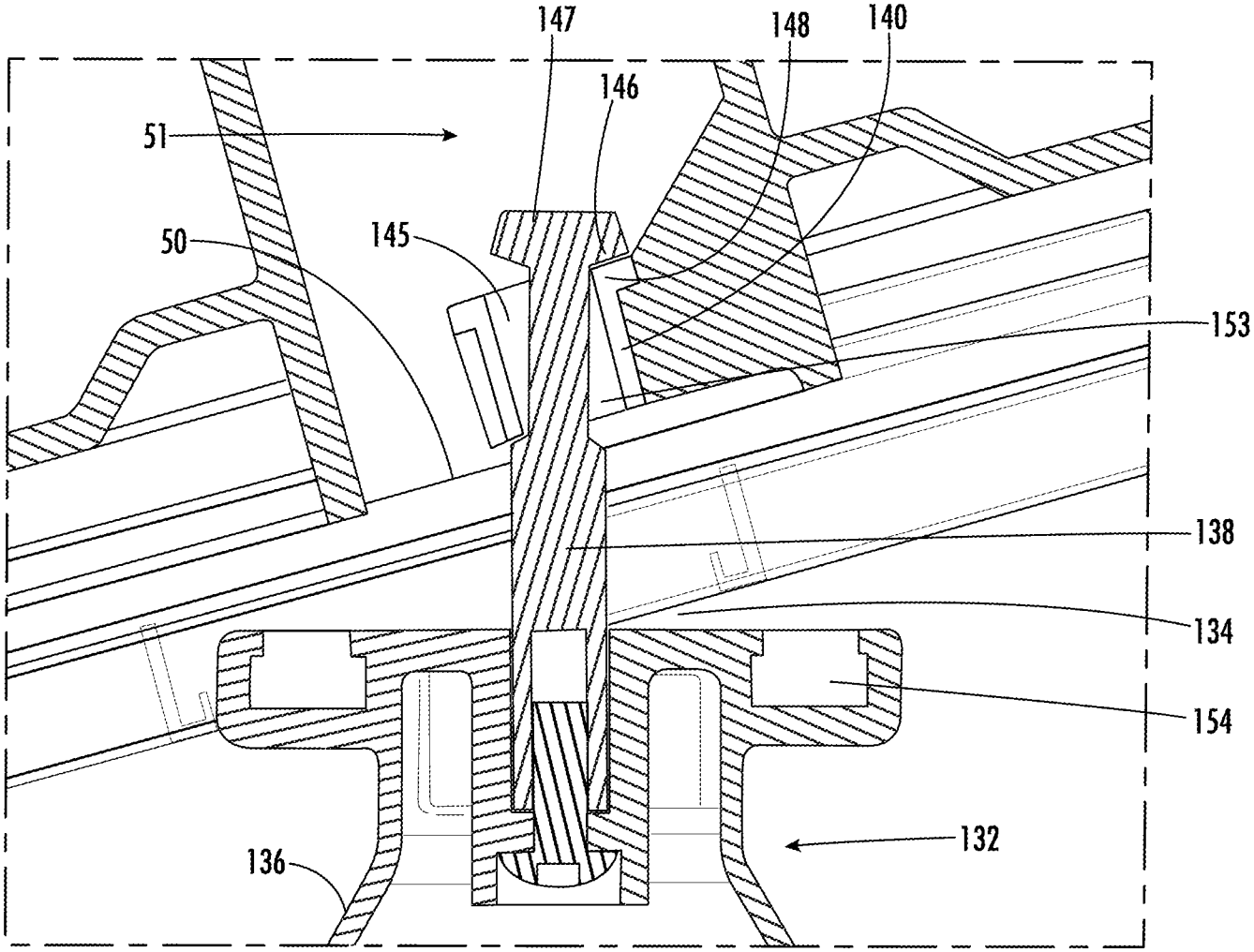
FIG. 7 is a detail of the cross-sectional view of FIG. 6 showing a first interconnecting member and a second interconnecting member of the shutoff float.

As shown in FIG. 7, the shutoff float 132 is supported in the recovery tank 20 by the neck 138 engaging a float guide 140. The float guide 140 forms a bushing or sleeve portion 145, and the float neck 138 is positioned such that it extends from the float body 136 through the sleeve portion of the guide 140. The neck includes a stop 147 at the end of the neck sized such that the stop will not slide through the sleeve portion so that the neck 138 remains in the float guide 140.

Figure 8:
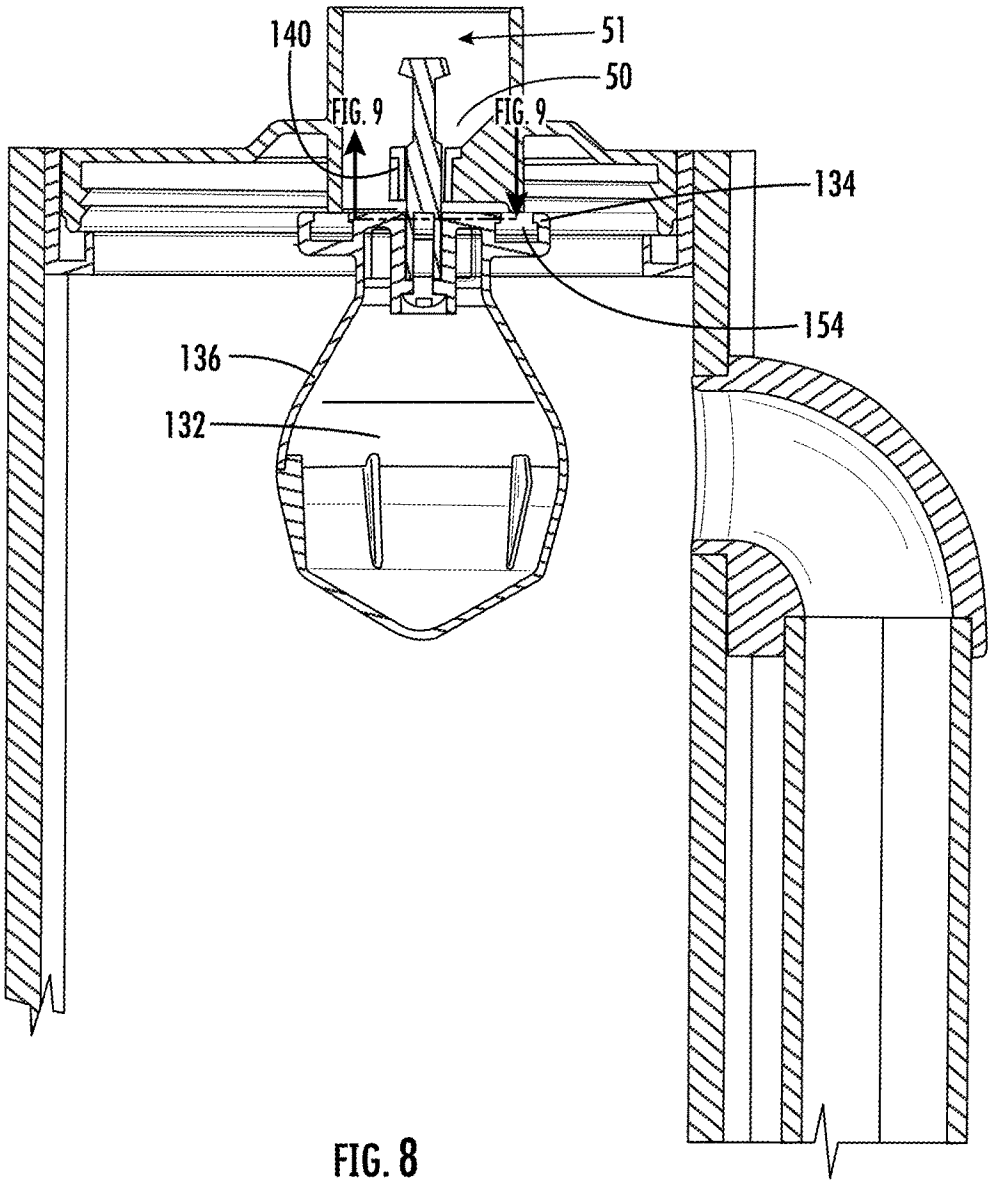
FIG. 8 is a partial cross-sectional view of the recovery tank and the shutoff float of FIG. 6, the shutoff float shown in a second position.
Figure 9:
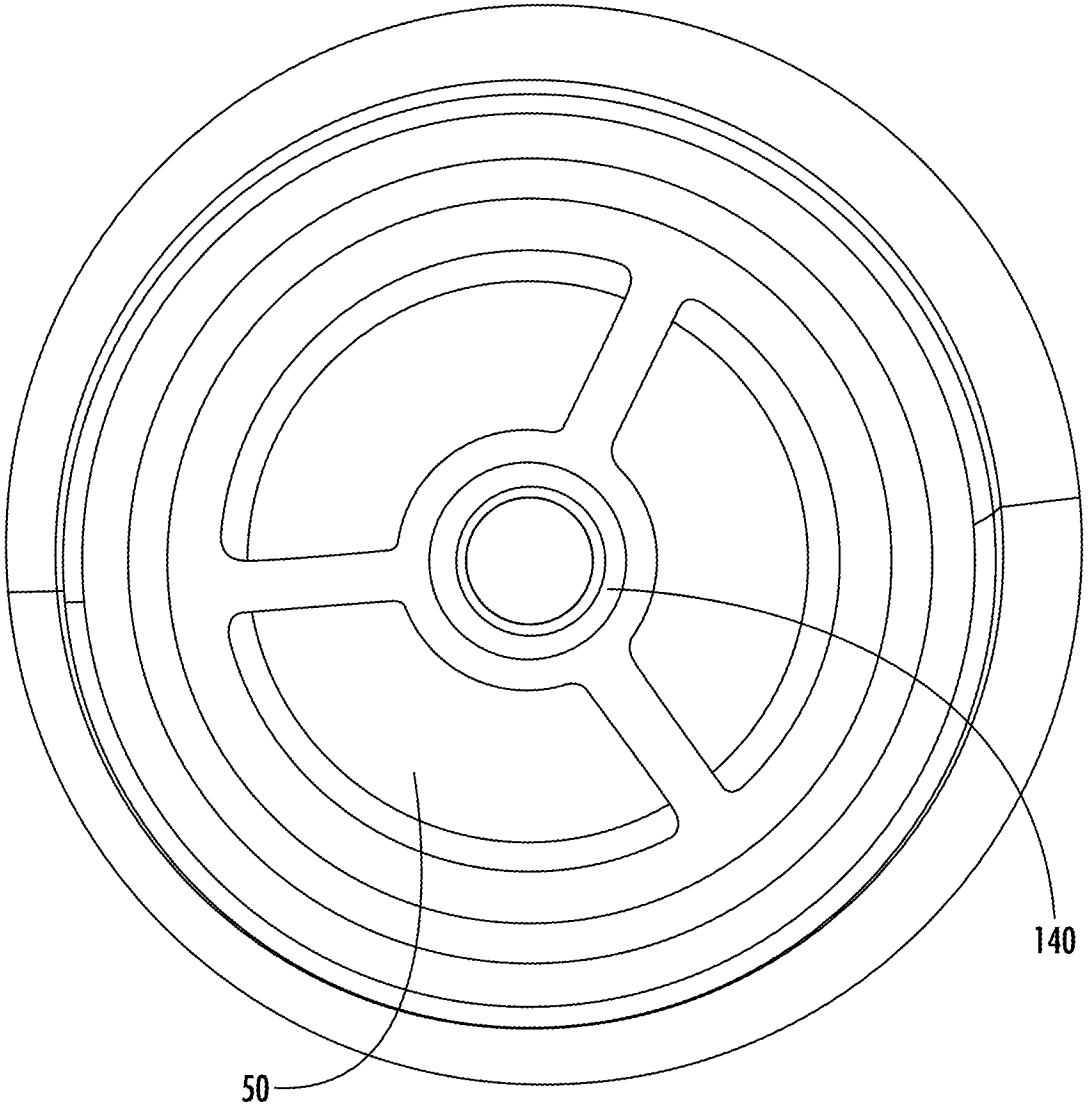
FIG. 9 is a sectional view through the recovery tank of FIG. 8 showing a closure of the shutoff float and a suction air outlet.

The float 132 is positionable in a first position in which the float 132 is a predetermined distance from the outlet 50 enabling air flow through the outlet 50 (FIGS. 6 and 7) and a second position in which the float 132 is in communication with the outlet 50 inhibiting air flow through the outlet 50 (FIG. 8). When the handle portion 16 and the recovery tank 20 are tilted (e.g., about axis 15 of FIG. 1) to the inclined use position, gravity causes the shutoff float 132 to drop and the neck 138 to orient traverse the float guide 140 in the first position such that a first interconnecting member 146 engages a second interconnecting member 148 to retain the float 132 in the first position when the fluid in the recovery tank 20 is below a predetermined level. In this embodiment, the neck 138 and/or the stop 147 of the float includes the first interconnecting member 146. The float guide 140 includes the second interconnecting member 148. In the embodiment illustrated in FIGS. 6-9, the first interconnecting member 146 is an abutment and the second interconnecting member 148 is a mating surface. The abutment 146 engages the mating surface 148 when the float 132 is in the first position. When the fluid in the recovery tank 20 is below the predetermined level, the float 132 is retained in a first position by engagement of the first interconnecting member 146 and the second interconnecting member 148.

Figure 6:
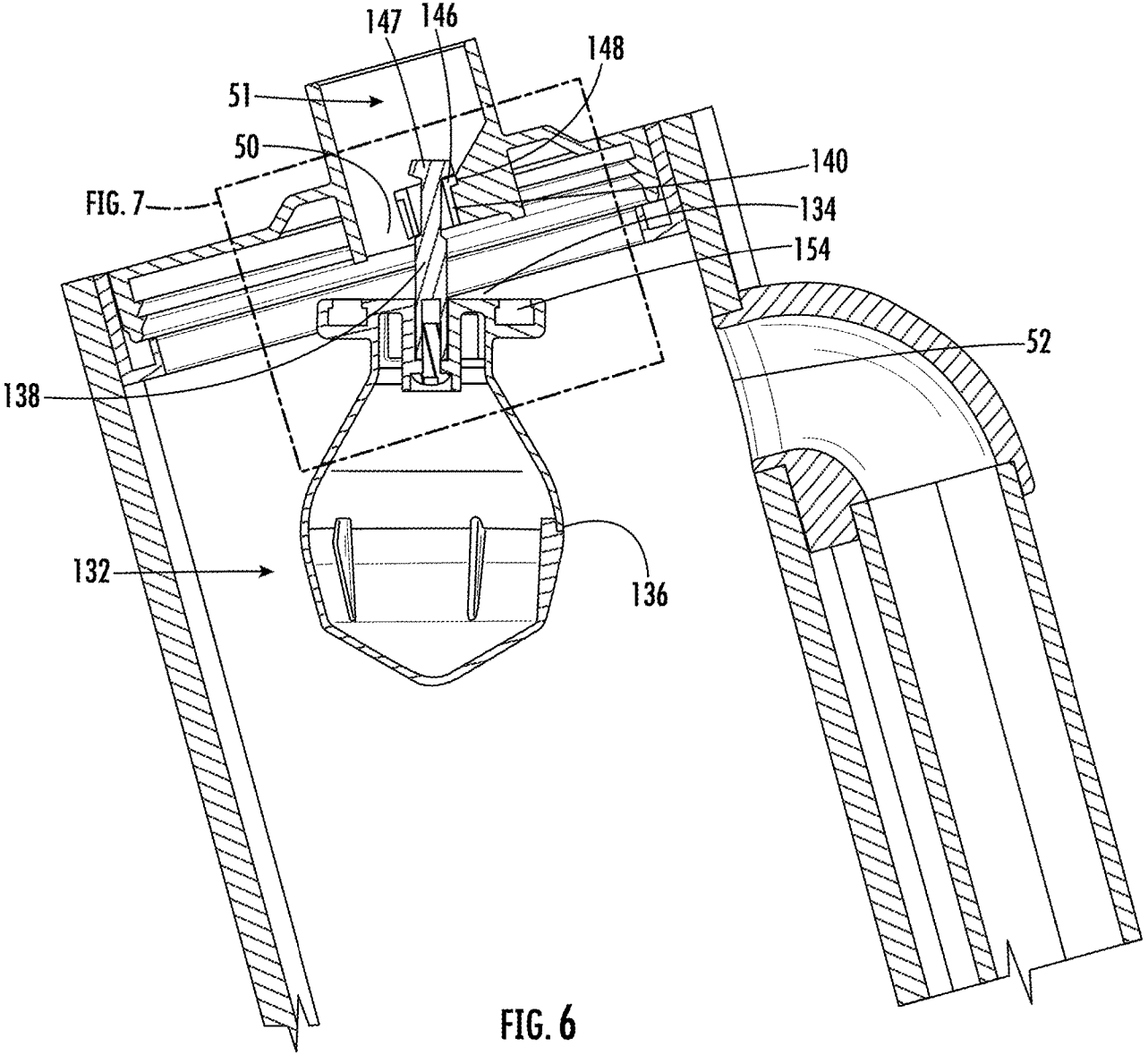
FIG. 6 is a partial cross-sectional view of a first alternative recovery tank and shutoff float arrangement inclined in an in-use position with the shutoff float in a first position.

In the embodiment of FIG. 6, the first interconnecting member 146 is positioned at an end of the neck 138, and the neck 138 extends as a cantilever from the second interconnecting member 148 in the first position. In one embodiment, the first interconnecting member 146 connects to the second interconnecting member 148 in a swivel engagement. As shown in FIGS. 6 and 7, the float guide 140 is a cylindrical sleeve along a sleeve axis, and the neck 138 extends along a neck axis that is transverse to the sleeve axis in the first position such that the first interconnecting member 146 engages the second interconnecting member 148. The cylindrical sleeve of the float guide 140 and the neck 138 and stop 147 form rolling surfaces such that the first interconnecting member 146 of the neck and/or stop rolls along the second interconnecting member 148 of the float guide 140 in the first position as the floor cleaner moves in the inclined use position. Stated another way, the neck 138 is configured to rotate within the float guide 140 in the first position.

Air and fluid enter the recovery tank 20 through the tank inlet 52 and are collected in the recovery tank 20. Once the fluid in the recovery tank 20 reaches or exceeds the predetermined level, the fluid causes the first interconnecting member 146 to disengage the second interconnecting member 148 as the float body 136 floats on the fluid and the neck 138 orients along the sleeve axis. As the fluid level rises in the recovery tank 20, the float 132 is guided toward the suction air outlet 50 and the second position as the neck 138 passes through the float guiding sleeve 140. With continued fluid ingress the closure 134 is raised until the closure 134 is received in the suction air outlet 50 to close the suction air outlet 50 when the fluid reaches or exceeds a desired level.

In one embodiment, a gasket 154 at least partially closes a gap between the float 132 and an edge of an aperture 153 on a first side of the guiding sleeve 140 to inhibit debris entering the outlet passageway 51 when the float 132 is in the first position. In one embodiment, the first side of the guiding sleeve 140 includes the gasket 154 at least partially closing the aperture 153 configured to engage the float 132 to inhibit debris entering the guiding sleeve 140 when the float 132 moves from the first position to the second position.

Figure 10:
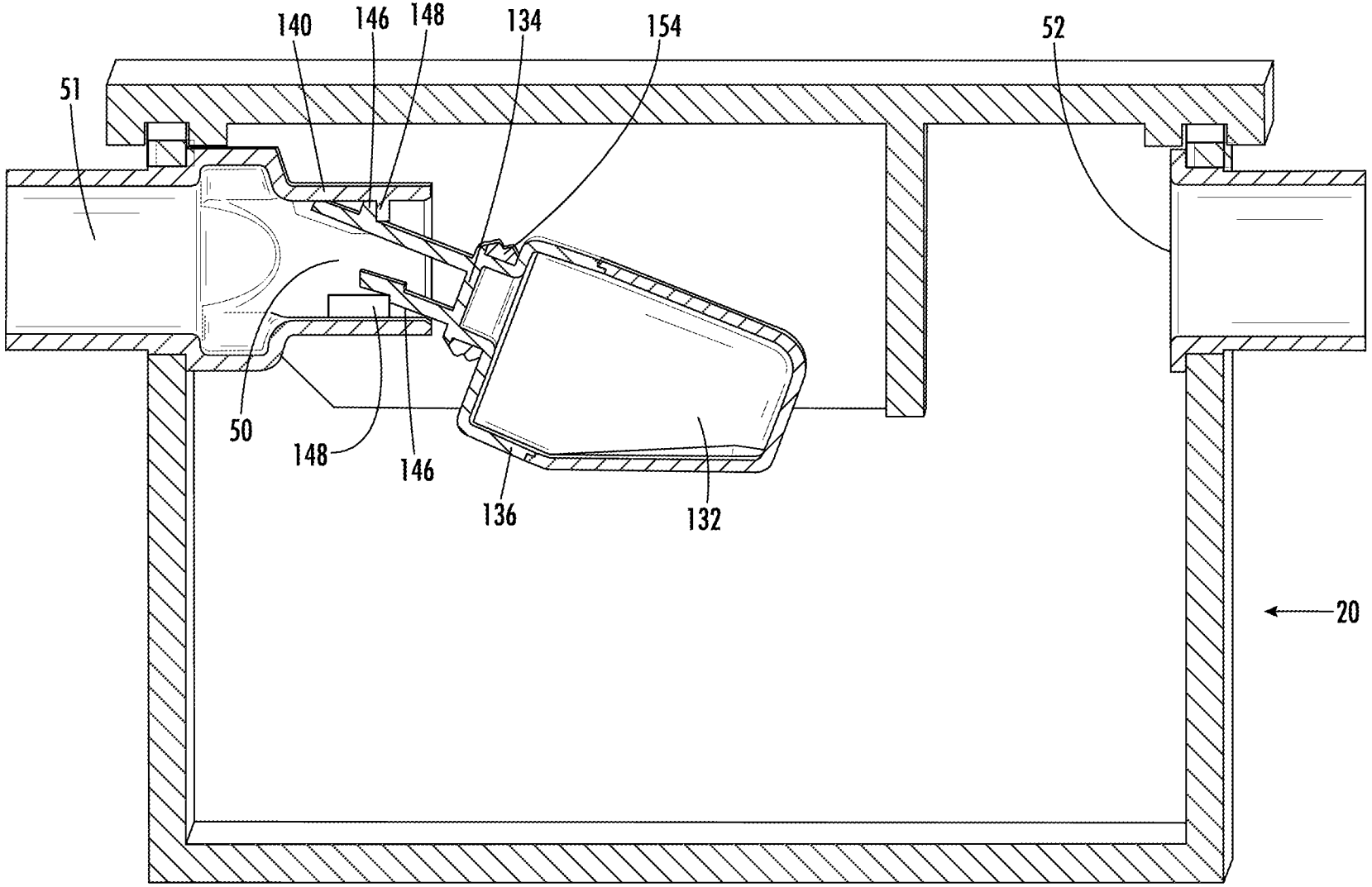
FIG. 10 is a partial cross-sectional view of a second alternative recovery tank and shutoff float arrangement with the shutoff float in a first position.
Figure 11:
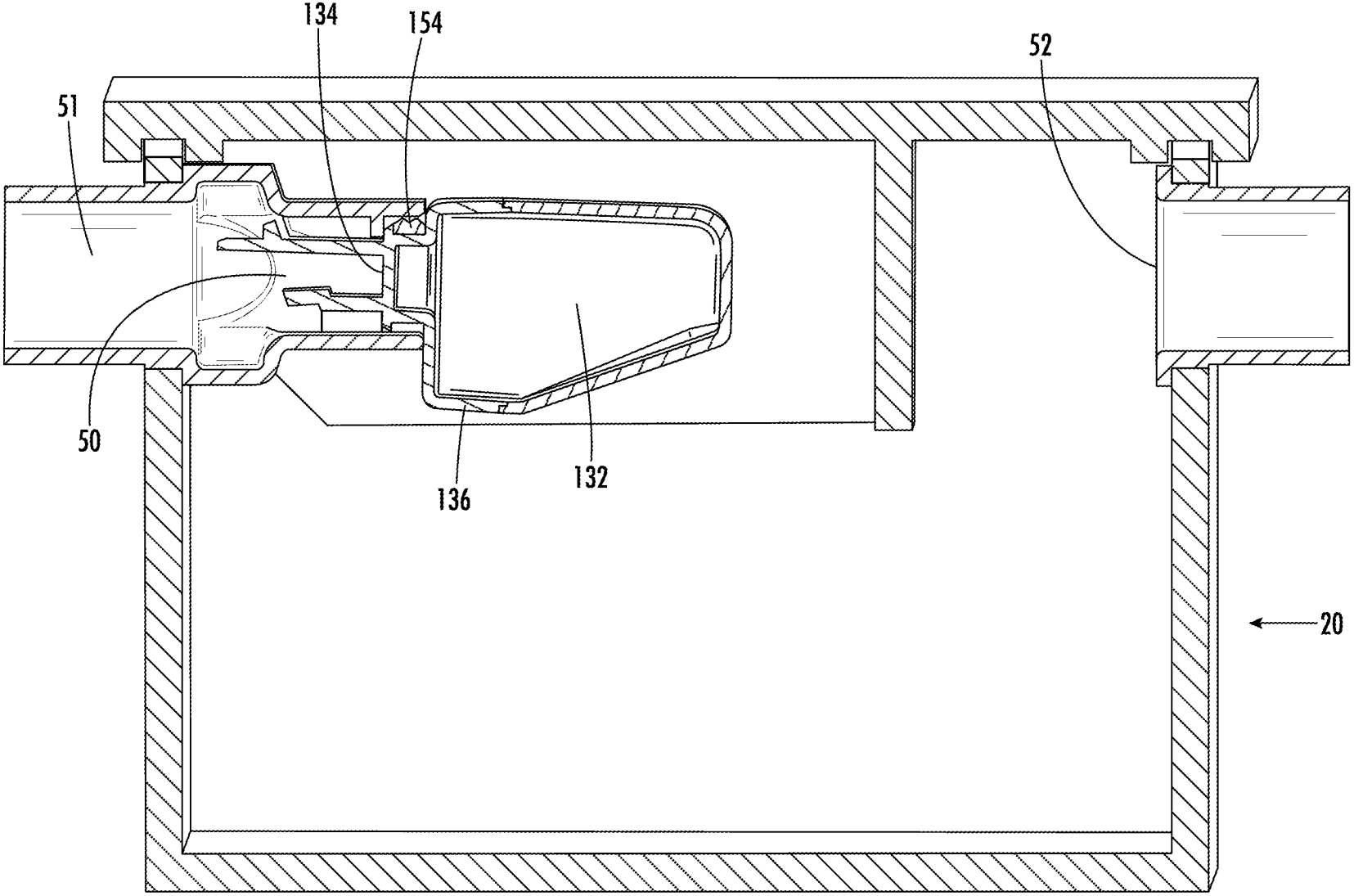
FIG. 11 is a partial cross-sectional view of the recovery tank and shutoff float arrangement of FIG. 10 with the shutoff float in a second position.

In the embodiment shown in FIGS. 10 and 11, the recovery tank is oriented in a horizontal orientation. This orientation may be used for floor cleaners having the recovery tank 20 mounted on a foot or base portion of the floor cleaner. In this embodiment, a float 132 includes a float body 136 and a float closure 134. The float 132 is guided by a shaft 140 in a substantially horizontal direction.

In the embodiment illustrated in FIGS. 10 and 11, the first interconnecting member 146 is a first protrusion and the second interconnecting member 148 is a second protrusion. The first protrusion 146 engages the second protrusion 148 to retain the float 132 in a first position (FIG. 10) when the fluid in the recovery tank 20 is below a predetermined level. The first protrusion 146 and second protrusion 148 are positioned inside of the guiding shaft 140. Once the fluid in the recovery tank 20 reaches or exceeds the predetermined level, the float body 136 floats on the fluid and the first protrusion 146 disengages the second protrusion 148. The float 132 is then directed by the guiding shaft 140 towards the suction air outlet 50, to a second position (FIG. 11). In the second position, the closure 134 is in communication with the suction air outlet 50, thus preventing air flow through the outlet 50.

In the embodiment illustrated in FIGS. 10 and 11, a gasket 154 is located around the closure 134. The gasket 154 communicates with an end of the guiding shaft 140 to inhibit debris from entering the outlet passageway 51 when the float 132 is in the second position (FIG. 11). In one embodiment, the gasket 154 is located on the end of the guiding shaft 140 and communicates with the closure 134 to inhibit debris from entering the outlet passageway 51 in the second position.

The handle portion 16 may be provided to rotate about the first axis 15 parallel to the surface to be cleaned to an inclined use position. In some embodiments, such as shown in FIG. 1, the handle assembly 16 also pivots about a second axis 17 transverse to the first axis to facilitate steering the floor cleaner 110 while in the inclined use position. We have found that steering in certain uses of floor cleaners in the prior art can cause movement of a shutoff float separate from movement of the float by buoyancy. The floor cleaner 10 provided with the first interconnecting member 46, 146 configured to engage the second interconnecting member 48, 148 during a steering motion of the handle portion 16 retains the shutoff float 32, 132 in the first position when the fluid is below a predetermined level. This reduces instances of the float 32, 132 inhibiting air flow through the outlet 50 while the floor cleaner is in the inclined use position and the fluid in the recovery tank 20 is below the predetermined level. When the fluid reaches the predetermined level, the buoyancy of the float body 36, 136 causes the float 32, 132 to rise, disengaging the first interconnecting member 46, 146 from the second interconnecting member 48, 148 and the float body 36, 136 floats on the fluid. Additional fluid causes the float 32, 132 to move from the first position to the second position.

The base 12 is movable over the surface 24 to be cleaned. The base 12 includes a suction inlet 26 in fluid communication with the vacuum source 22 and the recovery tank 20. The fluid is drawn from the surface 24 by the vacuum source 22 through the suction inlet 26 and into the recovery tank 20. The base 12 further includes a distribution nozzle 28 in fluid communication with the supply tank 18. The floor cleaner is configured to selectively deliver fluid from the supply tank 18 through the distribution nozzle 28 toward the surface 24.

In use, when there is no fluid in the recovery tank 20, the float 32, 132 will be in the first position. When there is an amount of fluid in the recovery tank 20 below the predetermined level, the float 32, 132 will remain in the first position. The float 32, 132 will be retained in the first position by the first and second interconnecting members 46, 48 and 146, 148 when the floor cleaner 10 is in the inclined use position and the fluid is below the predetermined level. When the amount of fluid in the recovery tank 20 exceeds the predetermined level, the buoyancy of the float 32, 132 will float on the fluid surface, the first interconnecting member 46, 146 will disengage the second interconnecting member 48, 148 and the float 32, 132 will be guided to the second position. In the second position, the closure inhibits airflow through the outlet 50 to reduce additional fluid from entering the recovery tank 20 and to inhibit fluid from passing through the suction air outlet 50.

Various features and advantages of the invention are set forth in the following claims.

What is claimed is:

1. A floor cleaner comprising:

a vacuum source;

a suction inlet in fluid communication with the vacuum source; and a recovery tank in fluid communication with the vacuum source and the suction inlet, the recovery tank configured to contain a fluid drawn by the vacuum source through the suction inlet from a surface to be cleaned, the recovery tank including a tank body, a tank inlet, and a suction air outlet;

a shutoff float including a float body and a closure, the shutoff float including a first interconnecting member, a float cage having a first end and a second end opposite the first end, the second end surrounding the suction air outlet, a second interconnecting member configured to engage the first interconnecting member;

wherein the shutoff float is positionable in a first position and a second position, wherein in the first position, the first interconnecting member engages the second interconnecting member retaining the closure a predetermined distance from the suction air outlet and inhibiting movement of the shutoff float toward the suction air outlet, wherein in the second position the closure is adjacent the second end of the float cage and in communication with the suction air outlet;

wherein the shutoff float is movable between the first position and the second position when the first interconnecting member disengages the second interconnecting member.

2. The floor cleaner of claim 1, wherein the first interconnecting member disengages the second interconnecting member when the fluid in the recovery tank reaches a predetermined level and the float body floats on the fluid.

3. The floor cleaner of claim 1, wherein engagement of the first interconnecting member and the second interconnecting member retains the shutoff float in the first position when the fluid in the recovery tank is below a predetermined level.

4. The floor cleaner of claim 1, wherein the float cage includes the second interconnecting member and the float cage further includes a screen that filters suction air flow before the suction air outlet.

5. The floor cleaner of claim 4, wherein the screen forms a peripheral surface of the float cage between the first end and the second end.

6. The floor cleaner of claim 1, wherein the shutoff float closes a portion of the first end of the float cage when the shutoff float is in the first position.

7. The floor cleaner of claim 6, wherein one of the shutoff float and float cage first end includes a gasket configured to engage the other of the shutoff float and float cage first end to inhibit debris entering the float cage when the shutoff float is in the first position.

8. The floor cleaner of claim 1, wherein the closure moves within the float cage as the shutoff float moves between the first position and the second position.

9. The floor cleaner of claim 8, wherein the closure is adjacent the first end and the neck extends through the first end when the shutoff float is in the first position.

10. The floor cleaner of claim 9, wherein the shutoff float closes a portion of the first end to inhibit debris entering the float cage when the shutoff float is in the first position.

11. The floor cleaner of claim 1, further including a user manipulatable handle portion pivotally connected to a base about a first axis parallel to the surface to be cleaned and a second axis transverse to the first axis, the recovery tank connected to the handle portion, wherein the first interconnecting member remains engaged to the second interconnecting member during pivotal motion of the handle portion about the second axis when the fluid in the reservoir is below a predetermined level.

12. A floor cleaner comprising:

a vacuum source;

a suction inlet in fluid communication with the vacuum source; and a recovery tank in fluid communication with the vacuum source and the suction inlet, the recovery tank configured to contain a fluid drawn by the vacuum source through the suction inlet from a surface to be cleaned, the recovery tank including, a tank body, a tank inlet, and a suction air outlet, a shutoff float including a float body and a closure, the shutoff float including a first interconnecting member, a float guide including a second interconnecting member configured to engage the first interconnecting member, the float guide configured to direct the shutoff float from a first position in which the first interconnecting member engages the second interconnecting member retaining the closure a predetermined distance from the suction air outlet inhibiting movement of the shutoff float toward the suction air outlet and enabling air flow through the outlet, toward a second position in which the closure is in communication with the outlet inhibiting air flow through the outlet, wherein the shutoff float is movable between the first position and the second position when the first interconnecting member disengages the second interconnecting member.

13. The floor cleaner of claim 12, wherein the first interconnecting member disengages the second interconnecting member when the fluid in the reservoir reaches a predetermined level and the float body floats on the fluid.

14. The floor cleaner of claim 12, the shutoff float further including a neck, wherein the first interconnecting member is positioned at an end of the neck and the neck extends as a cantilever from the second interconnecting member in the first position.

15. The floor cleaner of claim 12, wherein the first interconnecting member connects to the second interconnecting member in swivel engagement.

16. The floor cleaner of claim 12, further including a user manipulatable handle portion pivotally connected to a base about a first axis parallel to the surface to be cleaned and a second axis transverse to the first axis, the reservoir connected to the handle portion, wherein the first interconnecting member remains engaged to the second interconnecting member during pivotal motion of the handle portion about the second axis when the fluid in the reservoir is below the predetermined level.

17. The floor cleaner of claim 12, wherein the float guide is a float cage that includes a screen that filters suction air flow before the suction air outlet.

18. The floor cleaner of claim 17, wherein the screen forms a peripheral surface of the float cage.

19. The floor cleaner of claim 12, wherein one of the shutoff float and float guide includes a gasket configured to engage the other of the shutoff float and float guide to inhibit debris entering the suction air outlet when the shutoff float is in the first position.

20. The floor cleaner of claim 12, wherein the closure moves within the float guide as the shutoff float moves between the first position and the second position.

* * * * *